United States Patent [19]

Wirth

[11] 3,957,369

[45] May 18, 1976

[54] APPARATUS FOR DRYING A WET COPY SHEET IN A COPIER

[75] Inventor: Eugene Allan Wirth, Huntington, Conn.

[73] Assignee: Pitney-Bowes, Inc., Stamford, Conn.

[22] Filed: Sept. 24, 1974

[21] Appl. No.: 508,753

[52] U.S. Cl. ..... 355/10; 34/68; 34/160; 219/216; 219/388; 432/230

[51] Int. Cl.[2] ..... G03G 15/22

[58] Field of Search ..... 355/10, 17, 14, 27, 355/100, 106; 219/216, 388; 117/21, 37 LE; 432/59, 227, 230; 34/148, 68, 151, 155–160; 354/299

[56] References Cited

UNITED STATES PATENTS

| | | | |
|---|---|---|---|
| 3,432,639 | 3/1969 | Hull et al. | 219/216 |
| 3,677,635 | 7/1972 | Van Auken et al. | 355/11 |
| 3,804,516 | 4/1974 | De Mott | 355/14 X |
| 3,810,735 | 5/1974 | Moser | 432/59 |
| 3,826,892 | 7/1974 | Draugelis et al. | 432/59 UX |

*Primary Examiner*—L. T. Hix
*Assistant Examiner*—Kenneth C. Hutchison
*Attorney, Agent, or Firm*—Donald P. Walker; William D. Soltow, Jr.; Albert W. Scribner

[57] ABSTRACT

In an electrostatic copier of the type which utilizes a liquid developer for developing an electrostatic latent image formed on a copy sheet as a result of which the copy sheet becomes wet, there is provided improved apparatus for drying the wet copy sheet. The drying apparatus includes a movable belt, made of a strip of imperforate heat conductive material, for transporting the wet copy sheet in a predetermined path of travel through the drying station of the copier. The drying apparatus also includes a cover for deflecting air which is normally utilized for drying purposes, away from a portion of the belt so as to form first and second drying regions in the path of travel of the wet copy sheet. The drying apparatus additionally includes means for heating the moving belt at the first drying region, for urging liquid developer carried by the wet copy sheet towards the surface of the same which is disposed out of contact with the moving belt. Whereupon, air directed to the second drying region is sufficient to evaporate the liquid developer from the heated copy sheet, thereby drying the same.

7 Claims, 2 Drawing Figures

APPARATUS FOR DRYING A WET COPY SHEET IN A COPIER

BACKGROUND OF THE INVENTION

Electrostatic copying machines or copiers of the type which perform processes wherein an electrostatic latent image, formed on a photoconductively treated surface of copy sheet, is developed by contacting the same with a liquid developer; are generally provided with apparatus for drying the copy sheet at a drying station, after the latent image thereon is developed, since the copy sheet becomes wet in the course of developing the image thereon.

At the drying station of one known copier there is provided transporting means including a plurality of O-rings looped around a pair of suitably spaced and driven rollers, to dispose the O-rings abreast of one another in an endless conveyor configuration, for transporting the wet copy sheets, one after the other, in a horizontally extending path of travel through the drying station. And, to dry the wet copy sheets, there is provided a blower fan and suitable ductwork for directing a relatively large volume of air from the fan to the drying station, where the air evaporates liquid developer from the wet copy sheet as it is transported through the drying station. Although the O-rings from which the conveyor is constructed permit air from the ductwork to flow into contact with the surface of the copy sheet which is disposed on the conveyor, thereby facilitating the simultaneous evaporation of liquid developer from both surfaces of the wet copy sheets; the copy sheets are, more often than not, unacceptably damp after passing through the drying station.

Accordingly, an object of the present invention is to provide improved apparatus for drying a wet copy sheet in a copier; and Another object is to provide a copier having copy sheet drying apparatus which includes means for heating a wet copy sheet to facilitate thereafter air-drying the same.

SUMMARY OF THE INVENTION

In an electrostatic copier which includes developing means of the type which utilizes a liquid developer to develop an electrostatic latent image on a copy sheet, as a result of which the copy sheet becomes wet with liquid developer, there is provided apparatus for drying the wet copy sheet. The drying apparatus includes a movable belt, made of a strip of imperforate heat conductive material, for transporting the wet copy sheet in a predetermined path of travel. In addition, the drying apparatus includes means for forming first and second drying regions in the path of travel of the wet copy sheet, and means for heating the moving belt at the first drying region to urge liquid developer carried by the copy sheet towards the surface of the same which is disposed out of contact with the moving belt, so as to facilitate thereafter air-drying the heated copy sheet at the second drying station.

BRIEF DESCRIPTION OF THE DRAWINGS

As shown in the drawings wherein like reference numerals designate like or corresponding parts throughout the several figures.

DESCRIPTION OF THE PREFERRED EMBODIMENTS

Figure 1:
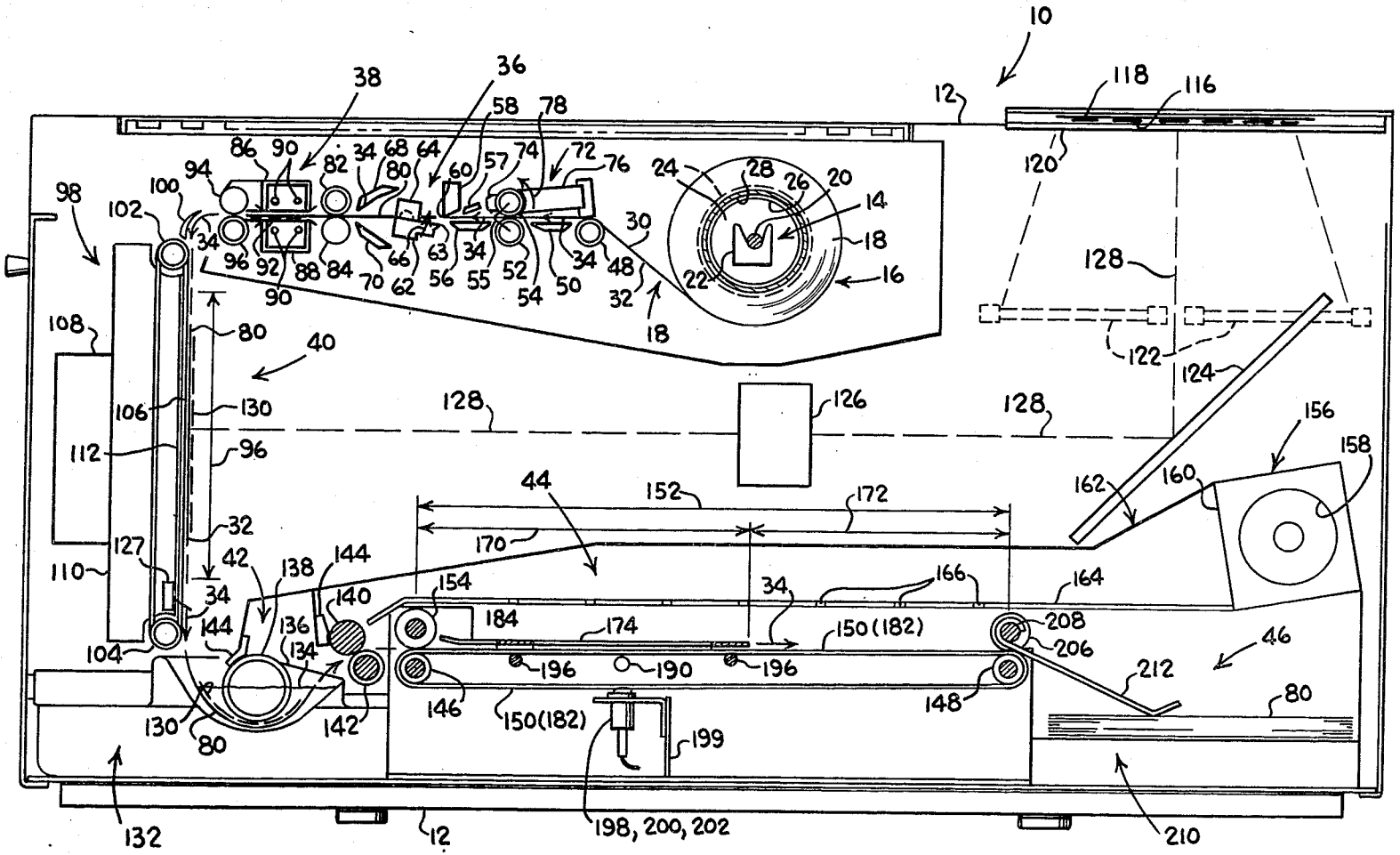
FIG. 1 is a schematic view of an electrostatic copier of the type which utilize a liquid developer for developing electrostatic latent image on copy sheets, in combination with improved apparatus, primarily at the drying station of the copier, for drying copy sheets which become wet in the course of development of the latent images thereon.

As shown in FIG. 1, an electrostatic copier 10 of the type which may be improved in accordance with the present invention generally includes suitable framework 12 for supporting the various components of the copier 10 including apparatus for carrying a supply roll 16 of copy sheet material 18.

The supply roll carrying apparatus, generally designated 14 (FIG. 1) includes an elongated shaft 20 supported by a pair of oppositely disposed brackets 22, one of which is shown, fixedly secured to the copier framework 12. The brackets 22 are respectively shaped to removably support the opposite ends of the shaft 20 so as to permit the shaft 20 to rotate in response to copy sheet material 18 being removed from the supply roll 16. The carrying apparatus 14 also includes a pair of disc-shaped, supply-roll end caps 24, one of which is shown. Each of the end caps 24 includes a circularly-shaped flange portion 26. The end caps 24 are removably mounted on the idler shaft 20, one near each of the supporting brackets 22. Preferably, the mounted end caps 24 are suitably secured to the shaft 20, for rotation therewith, with provision for positioning the end caps 24 lengthwise of the shaft 20. With the end caps 24 thus mounted on the shaft 20, the flange portions 26 extend toward one another and thus toward the supply roll 16. Since the supply roll 16 includes a cylindrically-shaped, open ended core 28 dimensioned to removably but tightly receive the respective end cap flange portions 26, successive supply rolls 16 may be removably mounted on the end caps 24 and thus on the shaft 20 for rotation therewith.

The copy sheet material 18 (FIG. 1) is made of a relatively stiff but flexible substratum material such as, for example, a strip of paper impregnated or coated on one of its surfaces with a suitable photoconductive insulating substance such as, for example, a zinc oxide powder dispersed in a suitable binder either alone or in combination with a suitable plasticizer and a suitable dye sensitizer. As shown in FIG. 1 the copy sheet material 18 is made as exemplified and has a non-photoconductive inner surface 30 and a photoconductive outer surface 32, as wound on the supply roll core 28.

The copier 10 (FIG. 1) is constructed and arranged to feed a discrete length of copy sheet material 18 through the copier 10 in a generally U-shaped path of travel 34, from the supply roll 16, through a cutting station 36, charging station 38, imaging station 40, developing station 42 and drying station 44, to a receiving station 46.

To guide the copy sheet material 18 (FIG. 1) away from the supply roll 16, an elongated rotatable guide roller 48 is provided. The roller 48 is suitably attached to copier framework 12 for movement in response to the copy sheet material 18 being urged against the same as the material 18 is fed downstream along its path of travel 34. In addition, a generally rectangularly-shaped plate 50 which extends beneath the sheet material 18 is provided for support and guidance purposes.

To feed the copy sheet material 18 from the supply roll 16 toward the cutting station 36, there is provided a pair of suitably driven, elongated rotatable feed rollers, 52 and 54. The rollers 52 and 54 are disposed parallel to one another and lengthwise opposite to one another above and below the sheet material 18, and are movably attached to the framework 12 for rotation in engagement with the sheet material 18. In addition, there is provided resilient means such as a pair of generally U-shaped springs 55, one of which is shown. The springs 55 are suitably attached to the ends of the feed rollers 52 and 54 for urging the same toward one another, and thus into engagement with the sheet material 18.

To guide the copy sheet material 18 (FIG. 1) into the cutting station 36, a pair of generally rectangularly-shaped upper and lower guide plates respectively numbered 56 and 57, are provided. The plates 56 and 57 are fixedly secured to the framework 12 and located relative to the sheet material 18 for guiding the same into its aforesaid path of travel 34. At the cutting station 36 there is provided a generally rectangularly-shaped, stationary, upper cutting blade 58 having a longitudinally-extending cutting edge 60. The cutting blade 58 is fixedly secured to the copier framework 12 so as to dispose the cutting edge 60 downstream of the guide plate 56, across the path of travel 34 of the copy sheet material 18 and next adjacent to the same. The copier 10 also includes a generally rectangularly-shaped, movable, lower cutting blade 62 at the cutting station 36. The lower blade 62 includes a cutting edge 63 which extends parallel to the upper cutting edge 60 and includes a lug 64 at each of the ends thereof, one of which is shown. The blade 62 is pivotally attached to the framework 12 by means of the lugs 64, to permit intermittent reciprocable movement of the blade 62 by suitable means (not shown), in an arcuate path of travel generally shown by the arrow 66. The copier 10 additionally includes a pair of generally rectangularly-shaped, upper and lower guide plates, respectively numbered 68 and 70, that are fixedly secured to the framework 12 and oriented relative to the copy sheet material 18 for support and guidance of the same in its path of travel 34 to the charging station 38.

When the supply roll 16 (FIG. 1) is initially loaded into the copier 10, a suitable length of the sheet material 18 is manually fed from the supply roll 16 over the guide roller 48 and guide plate 50, between the feed rollers 52 and 54, between the guide plates 56 and 57, and beneath the stationary upper cutting blade 58; to dispose the free end edge of the copy sheet material 18 in registry with the upper cutting blade edge 60. To facilitate such loading, suitable means are provided for separating the spring loaded feed rollers 52 and 54, such as a manually movable lever arm 72 pivoted to the upper roller 54. The arm 72 has a forwardly extending portion 74 and a rearwardly extending portion 76. The latter portion, 76, is adapted to be manually grasped for pivoting the arm 72 about the upper roller 54, in the direction indicated by the arrow 78, to urge the forwardly extending portion 74 into engagement with the lower roller 52, thereby separating the rollers 52 and 54 from one another against the tension of the springs 55. After disposing the free end of the copy sheet material 18 at the upper cutting edge 60, the arm 72 is pivoted in the opposite direction of the arrow 78, to dispose the arm's rearwardly extending end portion 76 on top of the sheet material 18, so as to hold the sheet material 18 in contact with the guide roller 48, and to permit rollers 52 and 54 to be spring urged into engagement with the copy sheet material 18 for feeding purposes.

Assuming a supply roll 16 (FIG. 1) is mounted within the copier 10, the copier 10 may be actuated by the operator to actuate suitable well-known means (not shown) for driving the feed rollers 52 and 54; the rollers 52 and 54 rotate in engagement with the sheet material 18 for a predetermined time interval, to feed a predetermined length of the sheet material 18 beneath the aforesaid upper cutting blade edge 60 and over the lower cutting blade 62. Whereupon, the movable cutting blade 62, which is driven by well-known means in timed relationship with movement of the rollers 52 and 54, pivots through the arcuate path of travel 66 to move the lower cutting edge 63 into cutting relationship with upper cutting edge 60, whereby the cutting edges 60 and 63 cooperate with one another for severing a copy sheet 80 from the supply roll 16 of sheet material 18 to form a copy sheet 80.

As thus formed, the copy sheet 80 (FIG. 1) is then automatically fed to the charging station 38 by well-known means including a pair of suitably driven, elongated, upper and lower feed rollers numbered 82 and 84, respectively. The rollers 82 and 84 are disposed parallel to one another, on opposite sides of the copy sheet 80, and lengthwise extend transverse to the path of travel 34 of the copy sheet 80 for rotation in engagement with the same.

At the charging station 38 (FIG. 1) the copier 10 may include any well-known electrically energizeable means for timely charging the copy sheet 80 including, for example, the upper and lower corona charging devices respectively numbered 86 and 88. Each of the charging devices 86 and 88 includes a pair of elongated high-voltage electrodes 90, for charging the opposite sides 30 and 32 of the copy sheet 80 to opposite electrical potentials. The electrodes 90 are oriented transverse to the path of travel 34 of the moving copy sheet 80 for charging the non-photoconductive surface 32 of the copy sheet 80 to a suitable polarity while depositing a uniformly distributed array of electrostatic charge 92 of the opposite polarity on the photoconductive inner surface 32.

The charged copy sheet 80 (FIG. 1) is thereafter fed to the imaging station 40 by suitable well-known means including, for example, a pair of suitably driven, elongated, upper and lower feed rollers respectively numbered 94 and 96. The rollers 94 and 96 are disposed parallel to one another, above and below the path of travel 34 of the copy sheet 80. In addition, the rollers 94 and 96 are movably attached to the framework 12 for rotation in engagement with the charged copy sheet 80.

At the imaging station 40 (FIG. 1), the copier 10 is provided with suitable well-known apparatus for transporting the copy sheet 80 through a flat, vertically oriented, exposure plane 96 for imaging purposes. The transporting apparatus, generally designated 98, may include, for example, copy sheet deflecting means such as an elongated plate 100 having a curvedly-shaped transverse cross-section for turning the moving copy sheet 80 downwardly along its path of travel 34. The transporting apparatus may also include a pair of suitably driven, elongated, upper and lower rollers which are respectively numbered 102 and 104; and include a perforated feed belt 106, endlessly looped around the rollers 102 and 104. The rollers 102 and 104 are lengthwise spaced parallel to one another and movably attached to the copier framework 12 for rotation in engagement with the belt 106, to drive the belt 106 continuously through the imaging plane 96. In addition, the transporting apparatus 98 may include vacuum header means such as a suitably driven exhaust fan 108 and an evacuateable chamber 110 coupled in air flow communication with one another. The chamber 110 has a flat, apertured wall 112 and is suitably mounted within the copier 10 so as to locate the apertured wall 112 in a vertically oriented plane extending parallel and next adjacent to the exposure plane 96. As thus located, the apertures (not shown) of the chamber wall 112 are disposed in air flow communication with the perforations (not shown) in the belt 106, when such perforations are moving downwardly through the exposure plane 96. Accordingly, as a copy sheet 80 is guided by the deflecting plate 100 into contact with the moving belt 106, the air drawn into the chamber 110, via the belt perforations and chamber wall apertures, entrains the copy sheet 80 and carries the same into flat surface contact with the moving belt 106. Whereupon the difference in air pressure on the opposite sides of the copy sheet 80, created by the fan 108 continuously exhausting the chamber 110, holds the copy sheet 80 in contact with the moving belt 106 for movement therewith, downwardly through the exposure plane 96.

Sometime during the time interval when the charged copy sheet (FIG. 1) is located in the exposure plane 96, it is exposed to information in the form of a graphic image 116 carried by a document 118 placed by the operator on a glass platen 120 secured to the copier's framework 12. To that end, the copier 10 includes, for example, one or more electrically energizeable light sources 122, a reflector 124 and an optical lens system 126; each of which is adapted by well-known means to cooperate with the other in response to, for example, a signal received from a switch 127 operable by the downwardly moving copy sheet 80, for illuminating the document 118 and flash exposing the charged photoconductive surface 32 of the copy sheet 80 with light 128 modulated by the graphic image 116, when the copy sheet 80 is disposed in the exposure plane 96. The graphic image modulated light 128 from the lens system 126 causes the electrostatic charge 92 on the photoconductive surface 32 of the copy sheet 80 to be selectively discharged from the photoconductive surface 32, to provide the same with a developable electrostatic latent image 130 which corresponds to the graphic image 116 on the document 118.

To develop the latent image 130 (FIG. 1) the copier 10 may be provided with any well-known liquid developing means, such as suitable spray-type liquid developing apparatus (not shown) which utilizes a liquid developer that does not include particles suspended therein, or bath-type liquid developing apparatus 132 which utilizes a liquid developer 134 including a fluid medium having suitably charged toner particles suspended therein for developing the latent image 130 on the copy sheet 80. The developing apparatus 132 includes an elongated tank 136 for holding a suitably replenishable supply of the aforesaid liquid developer 134 into which the image bearing copy sheet 80 is gradually immersed as it leaves the moving belt 106. To facilitate movement of the copy sheet 80 through the tank 136, the tank 136 is arcuately shaped in transverse cross-section. To maintain the charged toner particles of the liquid developer 134 evenly dispersed within the liquid medium thereof, and to promote movement of the image bearing copy sheet 80 through the tank 136, the developing apparatus 132 includes a suitably driven, elongated rotatable roller 138. The roller 138 longitudinally extends transverse to the path of travel 34 of the moving copy sheet 80 and is immersed in the tank 136 for rotation in the liquid developer 134. Preferably, the roller 138 is maintained by well-known means at a suitable predetermined electrical potential level, relative to the charges forming the latent image 130 on the copy sheet 80, to establish an electric field (not shown) in the liquid developer 134 which extends between the roller 138 and the latent image 130, so as to promote the migration of the charged toner particles out of the liquid developer 134 and into contact with the latent image 130, thereby rendering the latent image 130 visible. During development, the rotating roller 138, through movement of the liquid developer 134 and thus the immersed copy sheet 80, urges the wet copy sheet 80 into the nip between the outer surfaces of a pair of suitably driven, elongated, upper and lower feed rollers 140 and 142, at the drying station 44. Whereupon the wet copy sheet 80 is engaged by the rotating rollers 140 and 142 and squeezed therebetween to remove liquid developer 134 from the wet copy sheet 80 while feeding it out of the developer tank 136. To remove excess liquid from the upper roller 140 an elongated blade 144 may be provided. The blade 144 is lengthwise disposed in surface contact with the upper roller 140 for wiping the same as the rollers 140 and 142 feed the squeegeed copy sheet 80 into the drying station 44.

The wet copy sheet 80 (FIG. 1) is then fed through the drying station 44 by transporting means including a pair of suitably driven, elongated, feed rollers respectively numbered 146 and 148, and endless conveyor means 150 looped around the rollers 146 and 148. The rollers 146 and 148 are lengthwise horizontally spaced apart from one another and movably attached to the copier framework 12 for rotation in engagement with the conveyor means 150, for carrying the wet copy sheet 80 through the drying station 44 in a substantially horizontally extending path of travel generally designated by the numeral 152. At the entrance to the aforesaid path of travel 152, there is optionally provided an elongated blanket-type roller 154, which lengthwise extends parallel to the feed roller 148 and is suitably movably attached to the framework 12 for rotation in engagement with the squeegeed copy sheet 80, thereby removing some of the remaining liquid therefrom.

In accordance with the prior art, to remove the remainder of the liquid from the wet copy sheet 80 (FIG. 1), as it is being fed by the conveyor means 150 through the drying station 44, the copier 10 is provided with means for directing air to the drying station 44 including a suitably electrically energized blower fan 156, having an inlet 158 and an outlet 160. Since the fan 156 is fixedly secured to the copier framework 12 at a convenient location, a duct 162 is provided for guiding air from the fan 156 to the drying station 44. The duct 162, which is suitably coupled to receive air from the fan outlet 160, includes a generally rectangularly-shaped, flat, horizontally-extending, wall portion 164, having a plurality of air outlet apertures 166 formed therein to evenly distribute air from the duct 162 to the drying station 44, for drying the squeegeed copy sheet 80 as it is being fed through the drying station 44. Further, in accordance with the prior art, to promote the circulation of air around the squeegeed copy sheet 80 as it is being fed through the drying station 44; the conveyor means 150 has consisted of a plurality of O-rings (not shown) which are spaced abreast of one another on the feed rollers 146 and 148 so as to permit the free flow of air between O-rings and into contact with the under surface of the squeegeed copy sheet 80. With this arrangement the moving conveyor means 150 is constructed and arranged to promote the simultaneous evaporation of liquid from both surfaces of the squeegeed copy sheet 80.

Figure 2:
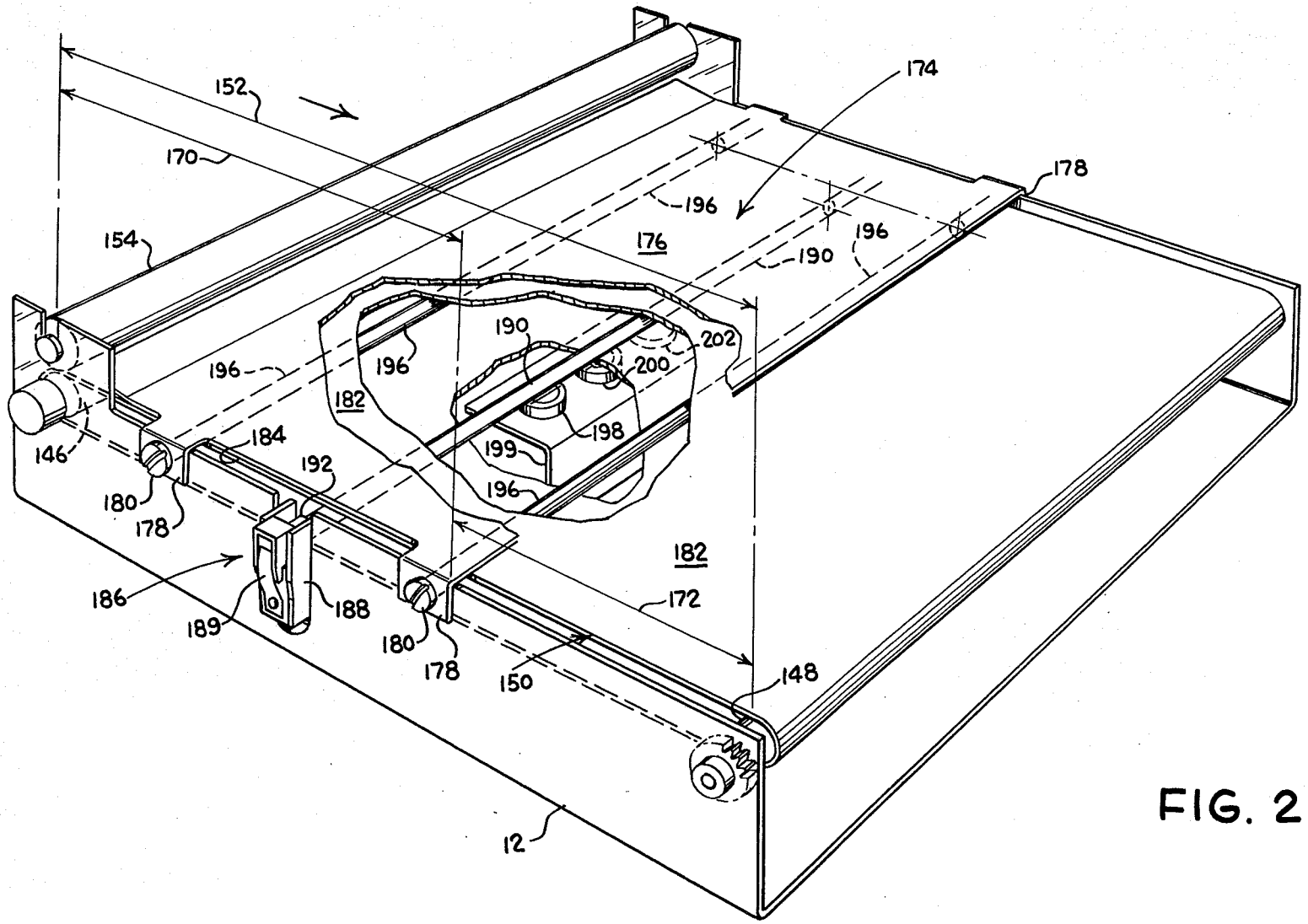
FIG. 2 is a perspective view of apparatus in accordance with the invention for drying wet copy sheets at the drying station of the copier shown in FIG. 1.

In accordance with the present invention, heat as well as circulating air is utilized for the purpose of removing the remainder of the liquid from the squeegeed copy sheet 80 (FIG. 1). To that end, the horizontally extending path of travel 152 of the wet copy sheet 80 is virtually divided into first and second drying regions, generally designated by the numerals 170 and 172, by means of a cover 174 which shields the first drying region 170 from air that would otherwise be distributed to the same from the outlet apertures 166 of the air duct 160. The cover 174 (FIG. 2) includes a generally rectangularly-shaped plate portion 176 and a plurality of depending leg portions 178. The leg portions 178 are suitably fixedly secured to the framework 12, as by means of a plurality of fasteners 180, to support the plate portion 174 above, parallel to, and in close proximity to the conveyor means 150. In addition, the conveyor means 150 is made of an imperforate strip of material, for forming an endless, imperforate, feed belt 182. The cover 174 and belt-type conveyor means 150 (182) thus define a generally rectangularly-shaped open-ended, but otherwise enclosed space 184 at the first drying region 170, through which the wet copy sheet 80 passes as it is carried through the drying station 44.

To heat the wet copy sheet 80 (FIG. 2) the heating means generally designated by the numeral 186 is provided. The heating means 186 includes a pair of oppositely disposed sockets 188, one of which is shown. The sockets 188 each have an electrical terminal 189 adapted to be energized from a suitable well-known source of supply of electrical power (not shown). In addition, the heating means 186 includes an elongated, rod-like infrared light radiating heat lamp 190, of a type well-known in the art. The heat lamp 190 has a plug portion 192 at each of the opposite ends thereof for removably mounting the lamp 190 in the sockets 188 for energization therefrom. As thus mounted, the lamp 190 lengthwise extends transverse to the direction of movement of the moving belt 182 and in sufficiently close proximity to the belt 182 to heat the same to a temperature within the range of from 150 to 250 degrees Fahrenheit. To facilitate the conduction of heat through the belt 182 to a wet copy sheet 80 disposed in surface contact with the feed belt 182, the belt 182 is preferably made of a heat conductive material such as silicone rubber or the like. And, to retard the dissipation of heat from the belt 182 to the copier framework 12, the feed rollers 146 and 148 are respectively coated with a non-heat conductive material such as rubber or the like. Further, to hold the moving belt 182 out of contact with the energized lamp 190, a pair of elongated belt guiding rods 196 are provided. The rods 196 are disposed parallel to one another and to the heat lamp 190 and suitably fixedly secured to the copier framework 12, as by means of the fasteners 180, to locate the rods 196 above the heat lamp 190 and on opposite sides of the same, and beneath the belt 182 but in contact with the same, for guiding the belt 182 in a path of travel above the heat lamp 190.

With the copier 10 (FIG. 1) modified as hereinbefore described, the wet copy sheet 80 enters the first drying region 170 and passes through the open-ended enclosed space 184, where heat from the irradiated belt 182 tends to boil or otherwise urge the liquid developer 134 carried by the wet copy sheet 80 toward the surface of the same which is disposed out of contact with the moving belt 182. Thereafter, when the wet copy sheet 80 enters the second drying region 172 and passes through the same, air from the fan 156 (FIG. 1) evaporates the remaining liquid from the copy sheet 80. It should be noted that although only one rather than both sides of the wet copy sheet 80 are exposed to drying air, and the air drying region 172 for a wet copy sheet 80 is approximately halved, due to modifications according to the invention, the wet copy sheet 80 is more completely dried than it is in a copier 10 which does not include such modifications.

To control energization of the blower fan 156 (FIG. 1), in consideration of the temperature to which the feed belt 182 is cooled by air from the blower fan 156, the copier 10 is modified to include temperature sensing means such as a thermostat 198, mounted on a support 199 which is suitably fixedly secured to the framework 12 for locating the thermostat 198 in contact with the heated moving belt 182 at a position in the path of travel of the same where the heated belt 182 has passed through the second drying region 172 but has not as yet been returned to the first drying region 170. As thus located, the thermostat 198 senses the temperature of the heated belt 182 after it has been cooled by the air from the fan 156 (FIG. 1) but before it is reheated. With this arrangement, a signal from the thermostat 198 may be utilized, for example, to operate a switch (not shown) which is electrically connected by well-known means for interrupting the transmission of electrical power to the fan 156, to interrupt energization of the fan 156 for a predetermined time interval whenever the temperature level of the moving belt 182 falls below a minimum desirable temperature level above which the belt 182 should be maintained for copy sheet drying purposes.

In addition, to control energization of the heat lamp 190 (FIG. 2) in consideration of the temperature of the heated belt 182 after it has passed through the second drying region 172 but before it is reheated, the copier 10 is further modified to include temperature sensing means such as another thermostat 200 (FIG. 2) located adjacent to the previously discussed thermostat 198. The second thermostat 200 may be utilized, for example, to operate a switch (not shown) which is electrically connected by well-known means for interrupting the transmission of electrical power to the lamp 190, to interrupt energization of the lamp 190 for a predetermined time interval whenever the temperature level of the moving belt 182 exceeds a maximum desirable temperature level which the moving belt 182 should not exceed for copy sheet drying purposes.

Further, to discontinue heating the feed belt 182 (FIG. 2) in the event that the belt 182 does not move, in which case the lamp 190 would rapidly overheat the belt 182, the copier 10 preferably includes a manually resettable thermostat 202 which is disposed adjacent to the other thermostats 198 and 200, in contact with the belt 182 and suitably connected by well-known means, for example, in series with thermostat 200, to disconnect the transmission of power to the lamp 190 when the temperature level of the belt 182 exceeds a predetermined maximum temperature level above the temperature level at which the thermostat 200 normally operates, to discontinue heating the moving belt 182. With this arrangement the thermostat 202 additionally acts as a safety switch for interrupting energization of the heat lamp 190 when the belt 182 is moving and being overheated due to the thermostat 200 failing to operate.

Upon being passed through the first and second drying regions 170 and 172 (FIG. 1) on the feed belt 182, dry copy sheet 80 is delivered to the receiving station 46. To that end, the copier 10 includes a suitably driven, elongated roller 206, mounted on a shaft 208 which is movably attached to the framework 12 to support the roller 206 for rotation in engagement with the surface of the feed belt 182. The roller 206 is mounted at the downstream end of the second drying region 172 to feed the dry copy sheet 80 from the belt 182 and into a suitably-shaped receptacle 210 located at the drying station 46. To guide the dry copy sheet 80 into the receptacle 210 one or more suitably-shaped elongated, rod-like arms 212 may be hung from the roller shaft 208 so as to extend therefrom to the receptacle 212. As thus mounted, the arms 212 extend from above the path of movement of the dry copy sheet 80 on the belt 182 to below the same, for guiding the dry copy sheet 80 downwardly from between the feed roller 206 and the feed belt 182 and into the receptacle 210, from which the dry copy sheet 80 may be retrieved by the operator.

In accordance with the objects of the invention there has been described improved apparatus for drying a wet copy sheet in a copier, including means for heating the wet copy sheet to facilitate thereafter air-drying the same.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In an electrostatic copier including developing means of the type which utilizes a liquid developer to develop an electrostatic latent image on a copy sheet, whereby the copy sheet becomes wet, and including squeegee means for removing excess liquid developer from the wet copy sheet, a movable belt for carrying in surface contact therewith the squeegeed wet copy sheet in a predetermined path of travel, and means for moving the belt, improved apparatus for drying the squeegeed wet copy sheet comprising:

a. means for forming first and second drying regions in the path of travel of the squeegeed copy sheet, said forming means including a cover mounted over the belt so as to deflect air away from the first drying region, and said forming means including said belt being made of a strip of imperforate material;

b. means for heating the moving belt at the first drying region, said heating means including an electrically energizable heating device for heating the belt surface opposite to the surface thereof on which the squeegeed copy sheet is normally disposed for movement with the belt, said belt being made of a heat conductive material to facilitate the conduction of heat through the moving belt to the squeegeed copy sheet at the first drying region, whereby the squeegeed copy sheet is heated and liquid developer carried by the squeegeed copy sheet tends to be urged toward the surface thereof which is disposed out of contact with the moving belt as the squeegeed copy sheet moves through the first drying region; and c. means for directing air toward the second drying region to evaporate liquid developer from the heated copy sheet as the heated copy sheet moves through the second drying region.

2. The drying apparatus according to claim 1 in a copier including framework at a drying station, said cover having a generally-rectangularly shaped plate portion and having a plurality of leg portions depending from the plate portion, and said leg portions fixedly secured to the framework so as to dispose the plate portion above and parallel to the belt.

3. The drying apparatus according to claim 1, wherein said heating device is an electrically energizeable infrared light radiating device disposed out of contact with the moving belt to irradiate the belt surface opposite to the surface thereof on which the squeegeed copy sheet is normally disposed for movement with the belt.

4. The drying apparatus according to claim 1, wherein said belt moving means includes a pair of elongated rotatable rollers around which the belt is endlessly looped for movement thereby, and said rollers being covered with a non-heat-conductive material for preventing the dissipation of heat therethrough from the heated moving belt.

5. The drying apparatus according to claim 1 including means for sensing the temperature level of the moving belt, and said sensing means electrically connected to interrupt operation of the air directing means in response to the sensed temperature level falling below a predetermined temperature level.

6. The drying apparatus according to claim 1 including means for sensing the temperature level of the moving belt, and said sensing means electrically connected to interrupt operation of the heating means in response to the sensed temperature level exceeding a predetermined temperature level.

7. The drying apparatus according to claim 1 including manually resettable means for sensing the temperature level of the heated belt, and said sensing means electrically connected to interrupt operation of the copier in response to the sensed temperature level exceeding a predetermined temperature level.

* * * * *